US011793368B2

(12) United States Patent
Hecker et al.

(10) Patent No.: US 11,793,368 B2
(45) Date of Patent: Oct. 24, 2023

(54) PAPER TOWEL DISPENSER

(71) Applicant: Lifetime Brands, Inc., Garden City, NY (US)

(72) Inventors: Reid Hecker, East Setauket, NY (US); Greg Hoge, Ridgewood, NY (US)

(73) Assignee: LIFETIME BRANDS, INC., Garden City, NY (US)

( * ) Notice: Subject to any disclaimer, the term of this patent is extended or adjusted under 35 U.S.C. 154(b) by 0 days.

(21) Appl. No.: 17/833,172

(22) Filed: Jun. 6, 2022

(65) Prior Publication Data

US 2022/0386828 A1 Dec. 8, 2022

Related U.S. Application Data

(60) Provisional application No. 63/208,139, filed on Jun. 8, 2021.

(51) Int. Cl.
*A47K 10/34* (2006.01)
*A47K 10/32* (2006.01)

(52) U.S. Cl.
CPC ..... *A47K 10/34* (2013.01); *A47K 2010/3233* (2013.01); *A47K 2010/3246* (2013.01)

(58) Field of Classification Search
USPC ..... 242/597.7
See application file for complete search history.

(56) References Cited

U.S. PATENT DOCUMENTS 899,461 A * 9/1908 McNeil ..... B65H 16/06 242/422.4
2,419,798 A * 4/1947 Stone ..... A47K 10/3836 242/571.5
3,770,221 A * 11/1973 Stern ..... B65H 75/08 242/596.7
4,273,299 A * 6/1981 Ness ..... A47K 10/3836 242/423.1
5,135,179 A * 8/1992 Morano ..... A47K 10/3836 242/565
5,170,956 A * 12/1992 McTaggart ..... A47K 10/3836 242/422.4
5,297,750 A * 3/1994 Hunt ..... B65H 35/002 242/422.4
6,092,758 A 7/2000 Gemmell
(Continued)

*Primary Examiner* — William A. Rivera
(74) *Attorney, Agent, or Firm* — Tutunjian & Bitetto, P.C.

(57) ABSTRACT

A paper towel dispenser includes two static positions, an "up" position and a "down" position. One embodiment includes an actuator lock component for engaging and displacing sliders. An actuator unlock component is positioned over the actuator lock component. The legs or extensions of the actuator unlock component extend in a downward direction. The body of the actuator is thus positioned above the sliders. The other embodiment includes spring leafs for engaging and displacing the sliders. The actuator is positioned under the spring leafs. The legs or extensions of the actuator extend in an upward direction. The body of the actuator is thus positioned below the sliders. In one embodiment, in the "up" position, the sliders extend outwardly and in the "down" position, the sliders extend inwardly, whereas, in the other embodiment, in the "up" position, the sliders extend inwardly and in the "down" position, the sliders extend outwardly.

13 Claims, 9 Drawing Sheets

(56) References Cited

U.S. PATENT DOCUMENTS

| | | | | |
|---|---|---|---|---|
| 6,357,687 | B1 * | 3/2002 | Liu | A47K 10/3836 242/422.4 |
| 6,478,246 | B2 | 11/2002 | Fahringer | |
| 7,104,418 | B2 | 9/2006 | Kamenstein | |
| 9,398,834 | B2 * | 7/2016 | Benedetti | A47K 10/38 |
| 9,730,560 | B2 | 8/2017 | Flocchini | |
| 2004/0195429 | A1 | 10/2004 | Demers et al. | |
| 2006/0219837 | A1 | 10/2006 | Yang et al. | |
| 2006/0284001 | A1 * | 12/2006 | Paradise | A47K 10/3836 242/597.7 |
| 2008/0061186 | A1 | 3/2008 | Nip et al. | |
| 2016/0270607 | A1 | 9/2016 | Zeng | |

* cited by examiner

UP POSITION

DOWN POSITION

UP POSITION

DOWN POSITION

UP POSITION

DOWN POSITION

UP POSITION

DOWN POSITION

PAPER TOWEL DISPENSER

RELATED APPLICATION INFORMATION

This application claims priority to Provisional Application No. 63/208,139 filed on Jun. 8, 2021, incorporated herein by reference herein in its entirety.

BACKGROUND

The present invention relates generally to paper towel dispensers, and more specifically, to paper towel dispensers that are supplied as sheets or rolls of any length and width which prevent the material from unraveling from the roll when a desired quantity is torn from the roll.

A number of household paper, plastic, tape and foil goods in common use are supplied as continuous sheets on rolls or tubes. The most common examples of these are paper towels, toilet paper, plastic wrap, adhesive tape and aluminum foil. In a number of cases, the sheets are perforated at regular intervals to allow an individual to select a desired quantity of material and easily separate it from the roll. Dispensing of these materials is made even easier by a variety of dispensing devices that are used to mount the roll or tube on a dowel or rod to allow easy unraveling of the sheets from the roll. A drawback of most dispensers is that because the roll of product is allowed to rotate freely, the force required to separate individual sheets from the roll frequently results in excess material being unraveled from the roll.

None of the prior art solutions provide an effective means for dispensing rolled materials without unraveling excess material from the roll. Thus, there is a need for a dispenser for rolled products which allows only a desired quantity of the product to be unraveled.

SUMMARY

In accordance with an embodiment, a paper towel dispenser is provided. The paper towel dispenser includes a sleeve attached to a base and a finial engaging interior components of the sleeve, the interior components including: sliders disposed on opposed ends of a central barrel, an actuator disposed over the central barrel, the actuator defining a pair of downward extensions, and an actuator lock component disposed under the central barrel, the actuator lock component configured to laterally displace the sliders.

In accordance with another embodiment, a paper towel dispenser is provided. The paper towel dispenser includes a sleeve attached to a base and a finial engaging interior components of the sleeve, the interior components including: sliders disposed on opposed ends of a central barrel, an actuator disposed under the central barrel, the actuator defining a pair of upward extensions, and a pair of spring leafs disposed over the central barrel, the pair of spring leafs configured to laterally displace the sliders.

It should be noted that the exemplary embodiments are described with reference to different subject-matters. In particular, some embodiments are described with reference to method type claims whereas other embodiments have been described with reference to apparatus type claims. However, a person skilled in the art will gather from the above and the following description that, unless otherwise notified, in addition to any combination of features belonging to one type of subject-matter, also any combination between features relating to different subject-matters, in particular, between features of the method type claims, and features of the apparatus type claims, is considered as to be described within this document.

These and other features and advantages will become apparent from the following detailed description of illustrative embodiments thereof, which is to be read in connection with the accompanying drawings.

BRIEF DESCRIPTION OF THE DRAWINGS

The invention will provide details in the following description of preferred embodiments with reference to the following figures wherein.

Throughout the drawings, same or similar reference numerals represent the same or similar elements.

DETAILED DESCRIPTION

Figure 1B:
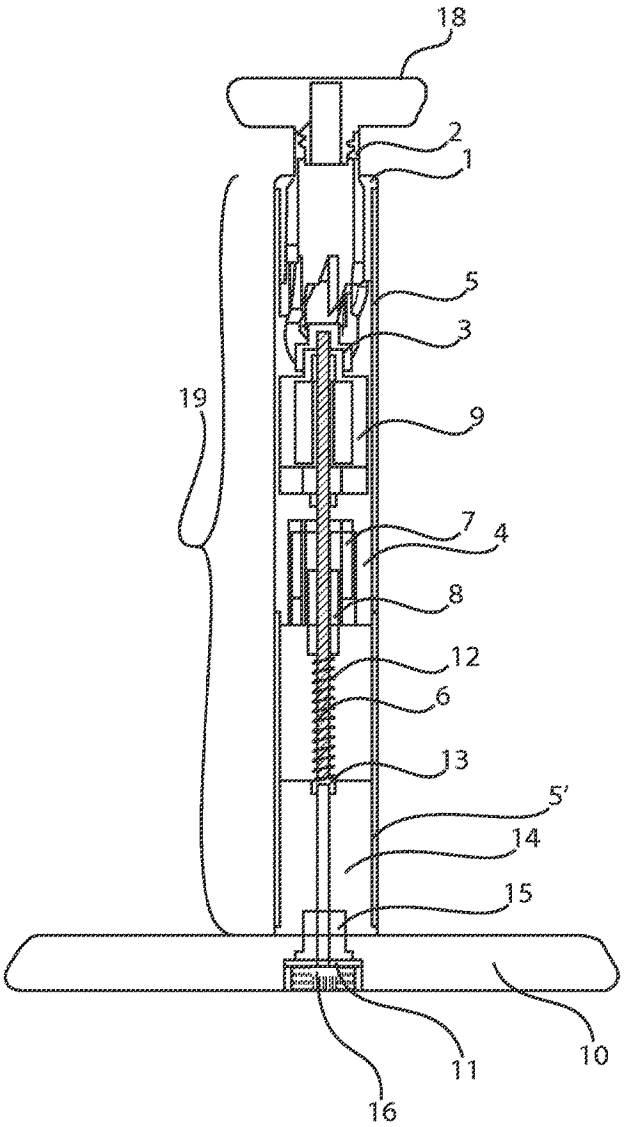
FIG. 1B illustrates a side, cross-sectional view of the paper towel dispenser of FIG. 1A, in accordance with an embodiment of the present invention.

Dispensers for dispensing sheets from a roll of perforated or non-perforated paper towels are generally intended for operation using both hands. One handed operation is notoriously clumsy and unreliable. Unfortunately, when the need for a paper towel arises, two hands are not always available for the task. Just about anyone in a modern kitchen has attempted to pull paper towels from a dispenser with one hand, only to struggle with the apparatus to get a sheet to tear properly in the first instance, and to prevent free spooling of the roll, and, thus, waste in the second instance. There remains an unfulfilled need for a paper towel dispenser capable of reliable one-handed operation in which a user can select and remove one or more sheets of one or more paper towels (or a length of paper of any desired length) while operating the dispenser with only one hand and where the material is prevented from unraveling from the roll when a desired quantity is torn from the roll.

Embodiments in accordance with the present invention provide for a paper towel dispenser capable of reliable one-handed operation in which a user can select and remove one or more sheets of one or more paper towels while operating the dispenser with only one hand and where the material is prevented from unraveling from the roll when a desired quantity is torn from the roll.

There are two separate and distinct embodiments. Each embodiment includes two static positions, that is, an "up" position and a "down" position. The first embodiment of the paper towel dispenser includes an actuator lock component for engaging and displacing the sliders. An actuator unlock component (or actuator) is positioned over the actuator lock component. The legs or extensions of the actuator extend in a downward direction. The body of the actuator is thus positioned above the sliders. The second embodiment of the paper towel dispenser includes spring leafs for engaging and displacing the sliders. The actuator is positioned under the spring leafs. The legs or extensions or wedge members of the actuator extend in an upward direction. The body of the actuator is thus positioned below the sliders. Additionally, in the first embodiment, in the "up" position, the sliders extend outwardly and in the "down" position, the sliders extend inwardly, whereas, in the second embodiment, in the "up" position, the sliders extend inwardly and in the "down" position, the sliders extend outwardly. Therefore, the same motions (upward or downward) in the first and second embodiments create different lateral displacement motions for the sliders.

It is to be understood that the present invention will be described in terms of a given illustrative architecture; however, other architectures, structures, substrate materials and process features and steps/blocks can be varied within the scope of the present invention. It should be noted that certain features cannot be shown in all figures for the sake of clarity. This is not intended to be interpreted as a limitation of any particular embodiment, or illustration, or scope of the claims.

Figure 1A:
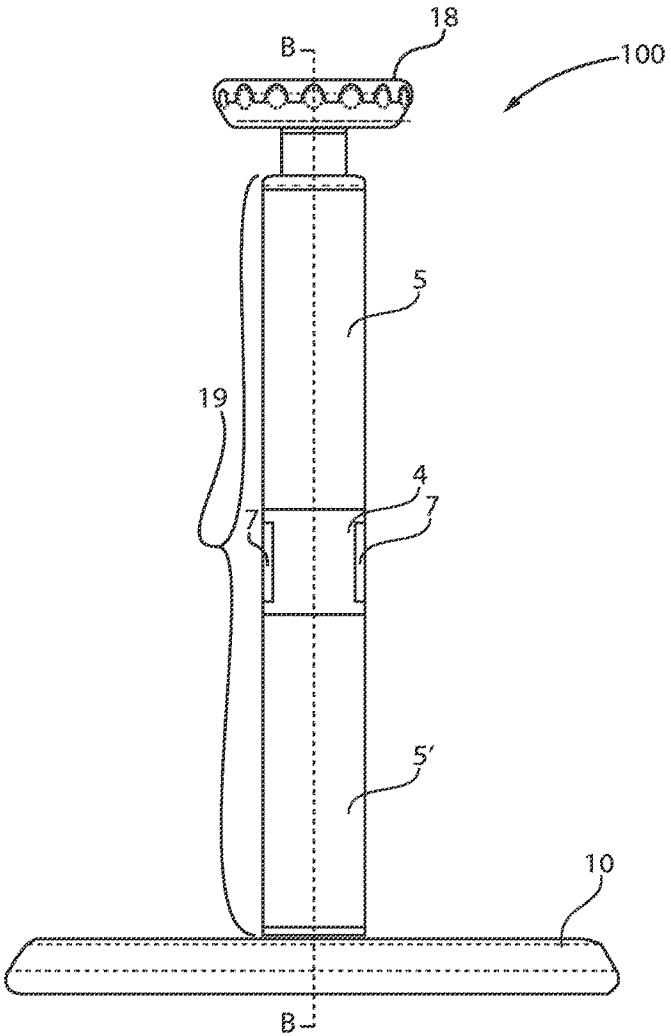
FIG. 1A illustrates a side view of a paper towel dispenser, in accordance with an embodiment of the present invention.

FIG. 1A illustrates a side view of a paper towel dispenser, in accordance with an embodiment of the present invention.

Referring first to FIG. 1A, wherein like reference numerals refer to like components in the various views, there is illustrated therein a new and improved paper towel dispenser for one-handed operation where the material is prevented from unraveling from the roll when a desired quantity is torn from the paper towel dispenser, generally denominated as 100 herein.

The side view of the paper towel dispenser 100 depicts an upper tube 5, a lower tube 5', and a central barrel 4. The central barrel 4 includes a pair of sliders 7. The sliders 7 can also be referred to as projections or extensions. A base 10 provides stability to the elongated portion or sleeve 19 (composed of the upper tube 5, the lower tube 5', and the central barrel 4). A finial 18 is axially disposed with respect to the upper tube 5, lower tube 5', and the central barrel 4.

FIG. 1B illustrates a side, cross-sectional view of the paper towel dispenser of FIG. 1A, in accordance with an embodiment of the present invention.

The side, cross-sectional view along axis B-B of FIG. 1A depicts the finial 18 engaging an upper cam 2. The upper cam 2 is accommodated within or is mounted within a guide 1. The guide 1 is fixed within the upper tube 5. The upper cam 2 slides within the guide 1. A lower cam 3 engages the upper cam 2 within the upper tube 5.

A shaft 6 extends into the lower cam 3. The shaft 6 extends through an actuator lock component 8 and an actuator unlock component 9. The actuator lock component 8 is positioned below the actuator unlock component 9.

The central barrel 4 include or defines sliders 7 on opposed ends thereof. The sliders 7 are vertically aligned with the upper tube 5 and the lower tube 5' when the finial 18 is depressed.

A spring 12 further surrounds a portion of the shaft 6. The lower cam 3 is always being pushed upwards against the upper cam 2 by the force of the spring 12.

A post insert 14 sits within the lower tube 5'. The shaft 6 does not extend into the post insert 14. The shaft 6 is secured to the actuator lock 8 via set screw 17. Post insert 14 is secured to the base 10 via the screw 16 and nut 13.

A bolt 16 is inserted through a clicker 11 and through the clicker lock 15 such that the bolt 16 engages the bottom surface of the nut 13. Moreover, a permanent friction fit or press fit between the lower tube 5' and the post insert 14 (along with the bolt 16 and the nut 13) is what attaches sleeve 19 to the base 10.

Figure 2:
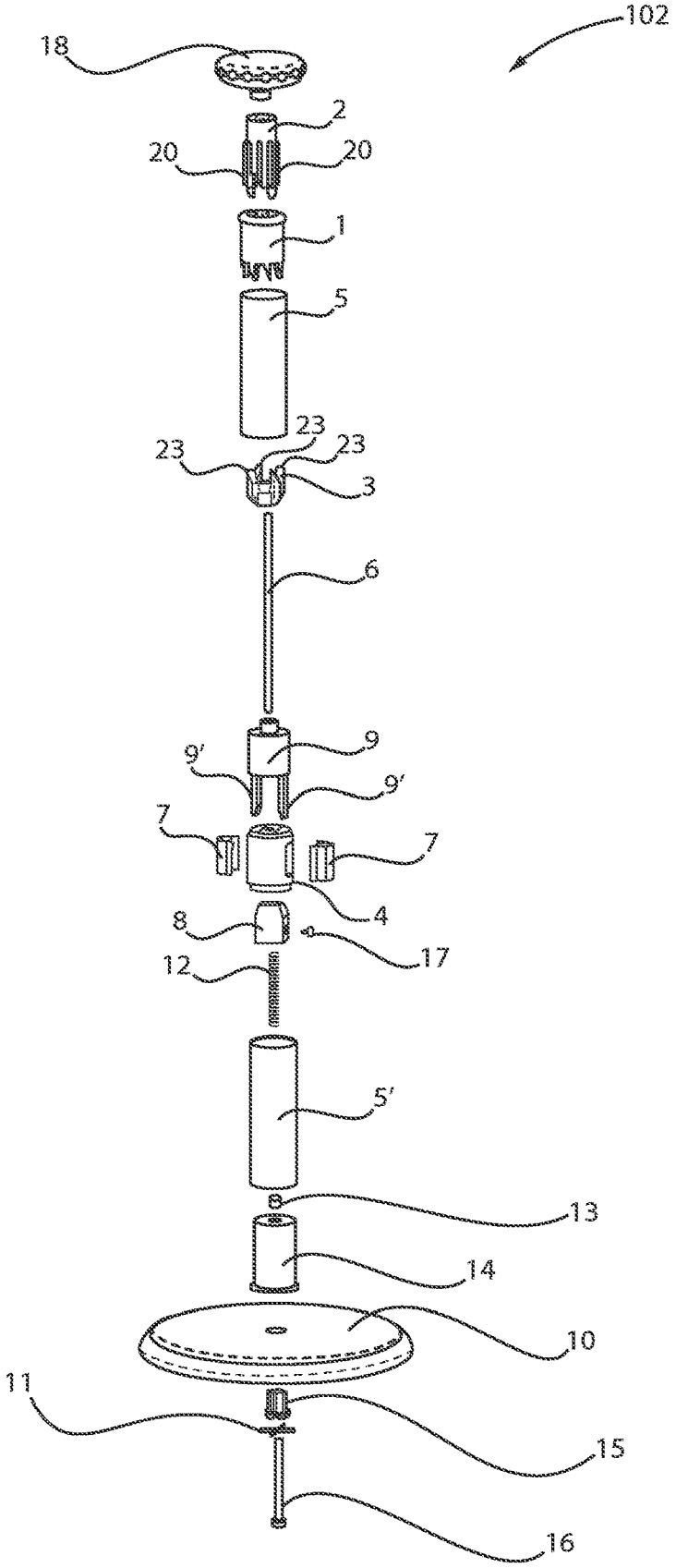
FIG. 2 illustrates an exploded view of the paper towel dispenser of FIG. 1A, in accordance with an embodiment of the present invention.

Therefore, the sleeve 19 is attached to the base 10, the sleeve 19 accommodating the upper cam 2 having a first set of arms 20 (FIG. 2) and the lower cam 3 having a second set of arms 23 (FIG. 2). The finial 18 releasably engages the sleeve 19, such that actuation of the finial 18 causes the lower cam 3 to engage the upper cam 2 such that the lower cam 3 rotates relative to the upper cam 2. Stated differently, the upper cam 2 is configured to engage the lower cam 3, the central barrel 4 includes a pair of sliders 7, an actuator is disposed within the central barrel 4, and a finial 18 is configured to engage the upper cam 2, such that actuation of the finial 18 causes the actuator to displace the pair of sliders 7.

FIG. 2 illustrates an exploded view of the paper towel dispenser, in accordance with an embodiment of the present invention.

The exploded view 102 depicts the inner components of the paper towel dispenser 100.

The finial 18 engages the upper cam 2. The upper cam 2 defines arms 20 circumferentially disposed about the outer surface of the upper cam 2, the arms 20 being equally spaced apart with respect to each other. The arms 20 extend below a bottom surface of the upper cam 2. The arms 20 can also be referred to as vertical projections. The upper cam 2 slidably fits or is mounted within the guide 1. The upper cam 2 with the guide 1 are inserted into the upper tube 5 such that the lower cam 3 engages the upper cam 2. The lower cam 3 defines arms 23 extending above a top surface of the lower cam 3. The arms 23 are configured to engage or cooperate with the arms 20 of the upper cam 2. The arms 23 of the lower cam 3 and the arms 20 of the upper cam 2 combined with the upward force of the spring 12 upon the lower cam 3 causes the lower cam 3 to rotate relative to the upper cam 2 with each downward push upon the finial 18.

A shaft 6 extends through the actuator lock component 8, the actuator unlock component 9, and the central barrel 4. The actuator unlock component 9 includes a pair of vertical, downward extensions 9'. The central barrel 4 accommodates sliders 7 on opposed ends thereof. Sliders 7 move in a lateral direction as discussed below with reference to FIGS. 8A-8B. A set screw 17 holds the actuator lock component 8 to the shaft 6. The spring 12 rests around the shaft 6.

The lower tube 5' accommodates the lower portion of the shaft 6, as well as the spring 12. The lower tube 5' further accommodates the post insert 14. The lower tube 5' engages the base 10. The base 10 is secured to the lower tube 5' via the bolt 16 extending through clicker 11 and clicker lock 15. A portion of clicker lock 15 extends within the confines of the lower tube 5'. Also, a portion of the bolt 16 extends through the lower tube 5' such that the bolt 16 engages the nut 13. The bolt 16 is vertically aligned with the shaft 6. The clicker lock 15 secures the bolt 16 in an upright position.

Post insert 14 is press fit with lower tube 5', and, therefore, they must rotate together. Clicker lock 15 is keyed to post insert 14, so that they will rotate together. Clicker 11 is further keyed to clicker lock 15. Thus, when the sliders 7 are engaged with a paper towel roll, rotation of the paper towel roll will rotate the entire sleeve 19, as well as clicker lock 15 and clicker 11. The arms of clicker 11 thus go in and out of bumps in the cavity of the base, creating friction against rotation of sleeve 19 (as well as simultaneously making numerous "click" sounds). It is noted that the bumps in the cavity of the base are a separate part in the second embodiment, that is, the "ratchet insert" in the base connect assembly 67.

Figure 3A:
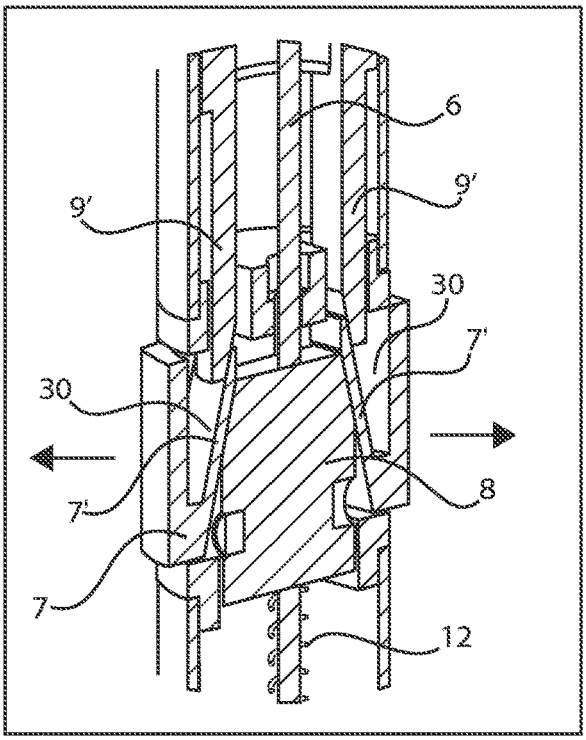
FIG. 3A illustrates a perspective, cross-sectional view of the paper towel dispenser when the finial is in the "up" position, and the sliders extend outwardly, in accordance with an embodiment of the present invention.

FIG. 3A illustrates a perspective, cross-sectional view of the paper towel dispenser when the finial is in the "up" position, and the sliders extend outwardly, in accordance with an embodiment of the present invention.

In the "up" position, the actuator lock component 8 is also in the "up" position. In this embodiment, the actuator lock component 8 is what presses against sliders 7 in an outward direction to "lock" the sliders 7 against the paper towel tube.

In the outward position, a gap 30 is present within the sliders 7. When an exposed paper towel is pulled, the paper towel roll rotates. Due to the friction between the sliders 7 and the paper towel tube, the entire assembly (that is, all parts except the base 10) will rotate when the paper towel roll rotates. When the actuator lock component 8 is in the "up" position, the assembly (with the exception of the base 10) is "engaged" with the paper towel roll. It should be noted that the friction between the sliders 7 and the interior of the paper towel tube is determined by the force of the spring 12 as well as the geometry and material of the sliders 7. Thus, varying the spring force, or the material or geometry of the sliders 7 affects the amount of friction between the sliders 7 and the interior of the paper towel tube. The objective is that, in the "up" position, the amount of friction will always be enough to keep the assembly engaged with the paper towel roll, so that they will rotate together.

Moreover, the clicker lock 15 rotates with the rest of the assembly when there is friction between the sliders 7 and the interior of the paper towel tube. As noted, in operation, when a user attempts to remove a sheet from the paper towel all the components rotate in unison, except for the base 10.

Figure 3B:
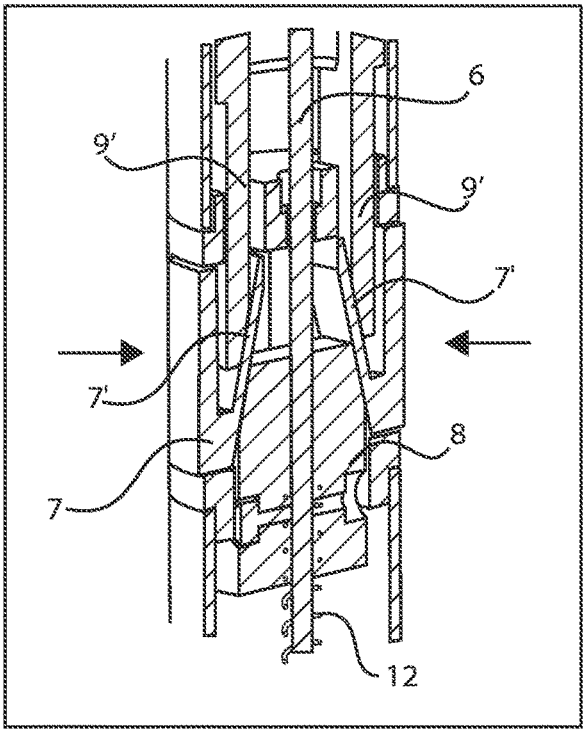
FIG. 3B illustrates a perspective, cross-sectional view of the paper towel dispenser when the finial is in the "down" position, and the sliders extend inwardly, in accordance with an embodiment of the present invention.

FIG. 3B illustrates a perspective, cross-sectional view of the paper towel dispenser when the finial is in the "down" position, and the sliders extend inwardly, in accordance with an embodiment of the present invention.

In the "down" position, the actuator unlock component 9 is also in the "down" position. The extensions 9' of the actuator unlock component 9 ride along the internal angled surfaces of the two sliders 7, forcing the sliders 7 inwards, thereby creating space or a gap between the sliders 7 and the interior surface of a paper towel tube. This allows a roll of paper towels to be freely placed onto or removed from the paper towel holder.

Additionally, the upper cam 2 moves to an "up" position inside a vertical column of the guide 1. In this configuration, the finial 18 can be removed by the user. The finial 18 is connected to the upper cam 2 via threaded or some other simple connection. It's only in the second embodiment (FIG. 4) where the finial 40 has a permanent press-fit connection with upper cam 44 so that the 40/44 assembly can only be removed when in the "up" position" and tabs on part 44 have rotated to clear tabs on lower cam 50.

Also, the spring 12 pushes the extensions 9' of the actuator unlock component 9 "up" so that the actuator unlock component 9 can pull the sliders 7 inward to free the paper towel tube.

Moreover, when in the "up" or "engaged" position the clicker 11 rotates when the paper towel roll rotates. Since the base 10 does not rotate with the rest of the assembly, the arms of the clicker 11 move in and out of divots in the base 10, thereby creating a clicking sound as well as providing some resistance against rotation of the rest of the assembly. The clicker 11 rotates within the stationary ridges and divots of the base 10. It should be noted that the ridges and divots in the base 10 can be a separate part from the base 10, understanding that this separate part must remain stationary with the base 10 and not rotate with the rest of the assembly.

Therefore, in FIGS. 3A-3B, the actuator lock component 8 is configured to engage an outer surface of angled portions 7' of the sliders 7 and the pair of downward extensions 9' is configured to engage an inner surface of the angled portions 7' of the sliders 7.

Figure 4:
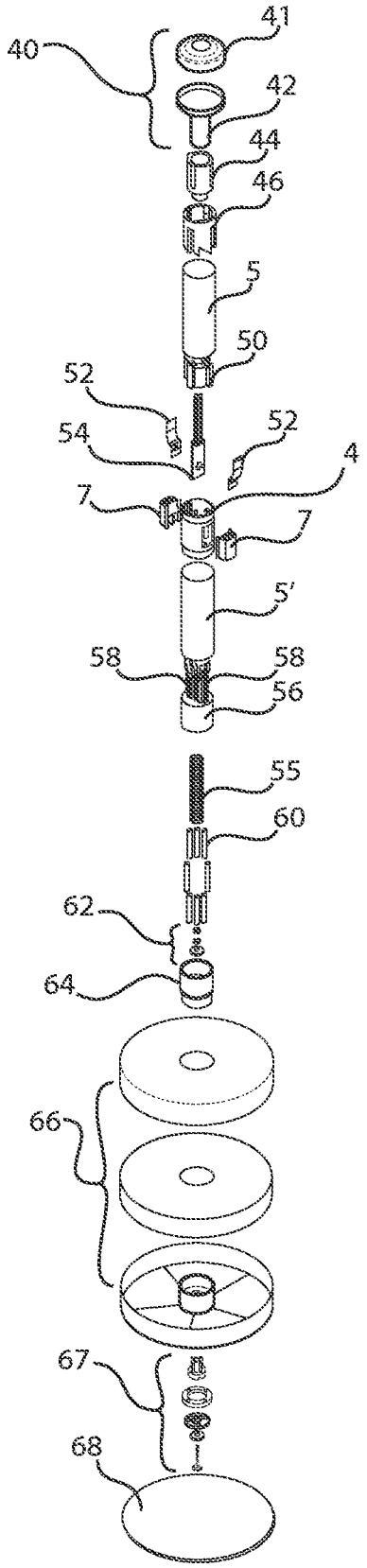
FIG. 4 illustrates an exploded view of a paper towel dispenser, in accordance with another embodiment of the present invention.

FIG. 4 illustrates an exploded view of a paper towel dispenser, in accordance with another embodiment of the present invention.

Figure 7A:
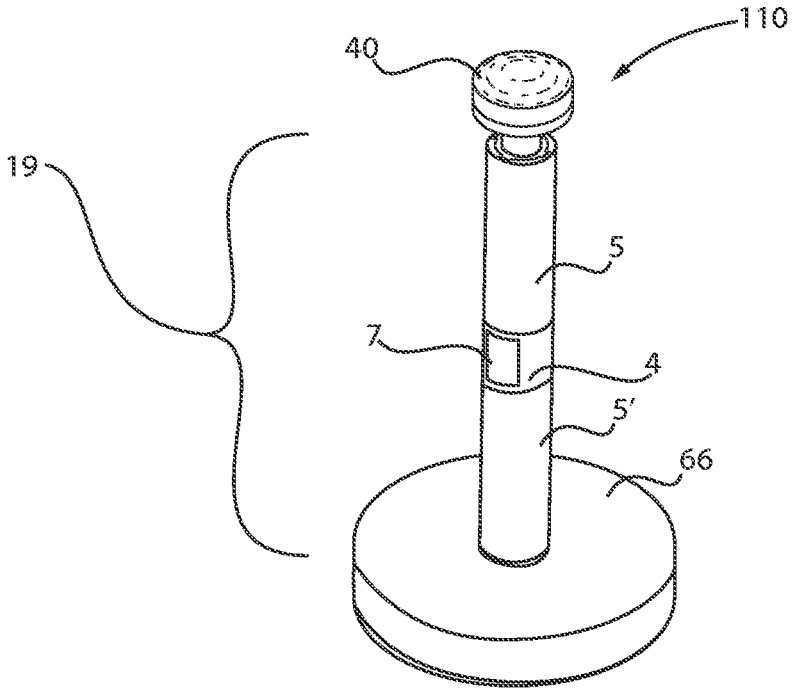
FIG. 7A illustrates a perspective view of the paper towel dispenser of FIG. 4, in accordance with an embodiment of the present invention.
Figure 7B:
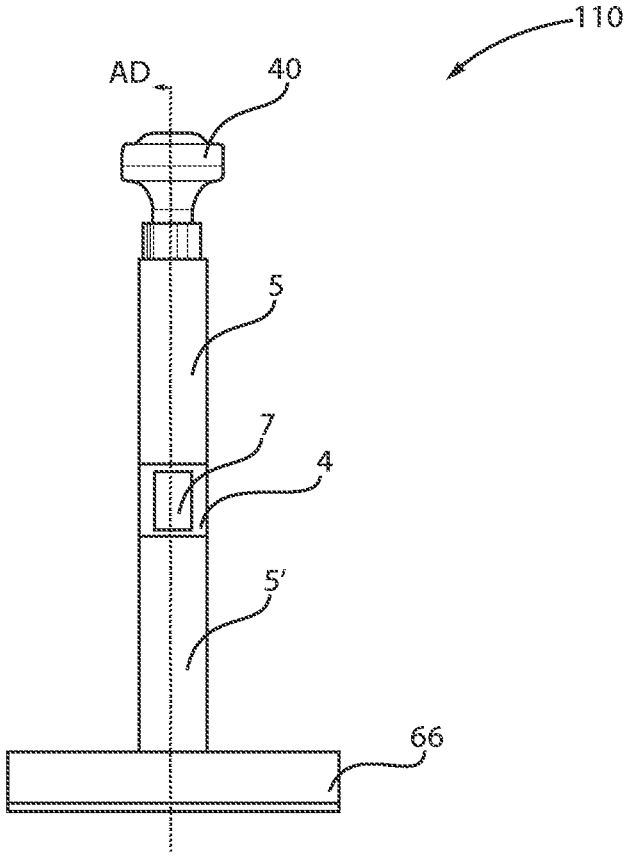
FIG. 7B illustrates a side view of the paper towel dispenser of FIG. 4 depicting the sliders extending inwardly, in accordance with an embodiment of the present invention.

The exploded view of the second embodiment depicts the inner components of the paper towel dispenser 110 (FIGS. 7A-7B).

The finial 40 is composed of a finial metal top 41 and a finial metal bottom 42. The finial 40 is received within a finial click 44 (or upper cam 44). The finial click 44 is accommodated within a click insert 46 (or guide 46). The upper cam 44 and the guide 46 are housed within the upper tube 5. A lower cam 50 engages the upper cam 44. A leaf spring shaft 54 includes a pair leaf springs 52. The leaf spring shaft 54 extends through the lower cam 50, the guide 46, and the upper cam 44 to secure such components within the upper tube 5.

The central barrel 4 accommodates sliders 7 on opposed ends thereof. Sliders 7 move in a lateral direction as discussed below with reference to FIGS. 9A-9B. An actuator 56 defining actuator wedges 58 (or upper extensions) engages the sliders 7. The actuator 56 is housed within the lower tube 5'. A spring 55 and weights 60 are housed within a bottom insert 64. The bottom insert 64 is secured to the base assembly 66, the base assembly 66 including a lower base, a base cover, and a weight incorporated therebetween. The base assembly 66 also has a foot 68 attached at a bottom end thereof. The washers/nuts 62 together with the bolt in assembly 67 is what secures base assembly 66 to bottom insert 64.

The second embodiment is different than the first embodiment described in FIGS. 1A-3B in that the second embodiment employs leaf springs 52 to displace the sliders 7, whereas the first embodiment employs the actuator lock component 8 to displace sliders 7. Additionally, in the first embodiment, the actuator unlock component 9 (or actuator) is positioned over the actuator lock component 8 or the element the displaces the sliders 7, whereas in the second embodiment, the actuator 56 (with actuator wedges 58) is positioned below the leaf springs 52 or elements that displace the sliders 7.

The leaf springs 52 include a pair of leaf springs. The leaf springs 52 can form a substantially or generally U-shaped configuration. The leaf springs 52 can be flat. The leaf springs 52 can be referred to as arms or vertical projections or vertical extensions.

Moreover, this reversal of elements between the first and second embodiments also provides reversed operation of the sliders 7. In particular, in the first embodiment, when the finial 18 is in the "up" position, the sliders 7 extend outward and when in the "down" position, the sliders 7 extend inward. In contrast, in the second embodiment, when the finial 40 is in the "up" position, the sliders 7 extend inward and when in the "down" position, the sliders 7 extend outward. This operation of the second embodiment will be described below with reference to FIGS. 5A and 5B.

Figure 5A:
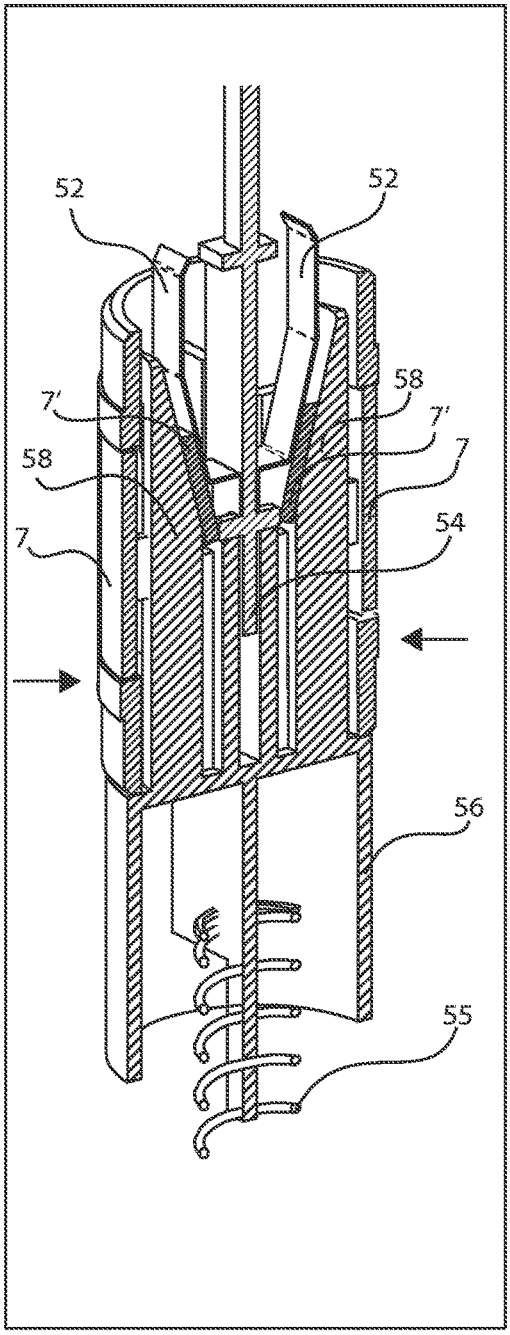
FIG. 5A illustrates a perspective, cross-sectional view of the paper towel dispenser of FIG. 4 when the finial is in the "up" position, and the sliders extend inwardly, in accordance with an embodiment of the present invention.

FIG. 5A illustrates a perspective, cross-sectional view of the paper towel dispenser of FIG. 4 when the finial is in the "up" position, and the sliders extend inwardly, in accordance with an embodiment of the present invention.

In the "up" position, the spring 55 pushes the actuator 56 up. The actuator wedges 58 pull the sliders 7 inward. The paper towel tube is thus freed (FIG. 9A) and the paper towel tube can thus be removed. In more detail, the inner surfaces of the actuator wedges 58 directly contact the angled portions 7' of the sliders 7. This enables the inward motion indicated by the arrows. The top edge of actuator wedges 58 do not contact the upper part of the central barrel 4 (in both the "up" and "down" positions). It is noted that the leaf springs 52 do not contact the angled portions 7' of the sliders 7. Thus, in the "up" position, there is a space between the leaf springs 52 and the angled portions 7' of the sliders 7. The upper portion of the leaf springs 52 extends above a top surface of the central barrel 4.

Figure 5B:
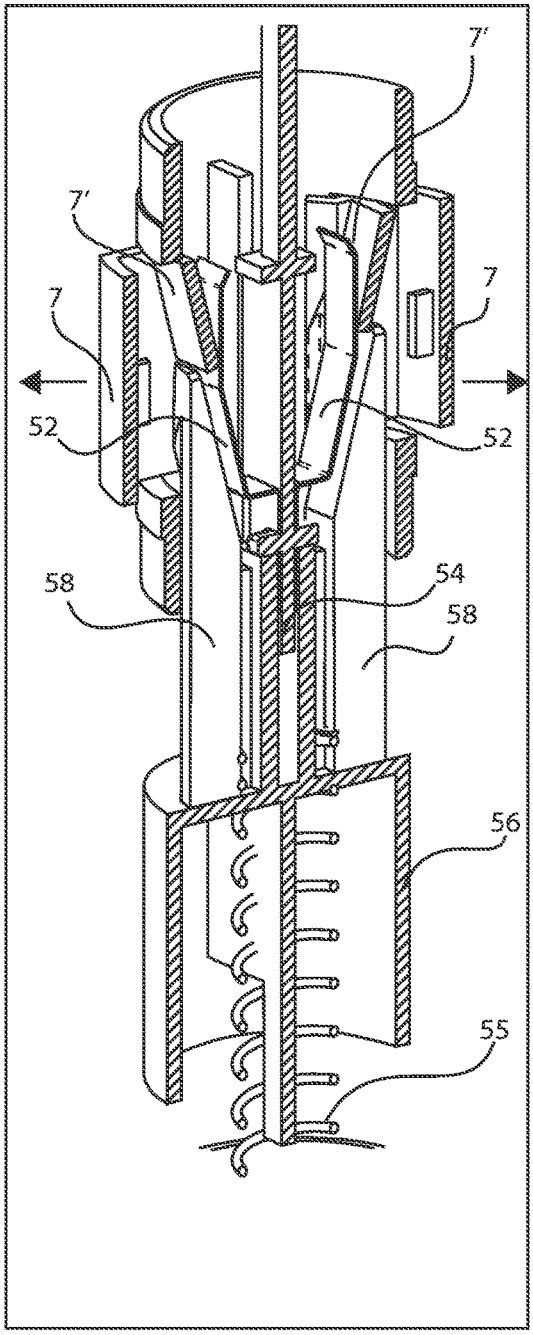
FIG. 5B illustrates a perspective, cross-sectional view of the paper towel dispenser of FIG. 4 when the finial is in the "down" position, and the sliders extend outwardly, in accordance with an embodiment of the present invention.

FIG. 5B illustrates a perspective, cross-sectional view of the paper towel dispenser of FIG. 4 when the finial is in the "down" position, and the sliders extend outwardly, in accordance with an embodiment of the present invention.

In the "down" position, the actuator wedges 58 are disengaged from the angled portions 7' of the sliders 7. The actuator wedges 58 do not contact the upper inner part of the central barrel 4. The leaf springs 52 are now put in motion to push the sliders 7 out or laterally. To do so, the leaf springs 52 engage the angled portions 7' of the sliders 7. In the "down" position, the leaf springs 52 are substantially centrally disposed within the central barrel 4 to fully engage the angled portions 7' of the sliders 7. The sliders 7 thus press against the inside of the paper towel tube (FIG. 9B) and the entire assembly (except for the base 66) rotates with the paper towel tube.

Therefore, in FIGS. 5A-5B, the spring leafs 52 are configured to engage an outer surface of angled portions 7' of the sliders 7 and the pair of upward extensions 58 is configured to engage an inner surface of the angled portions 7' of the sliders 7.

Figure 6A:
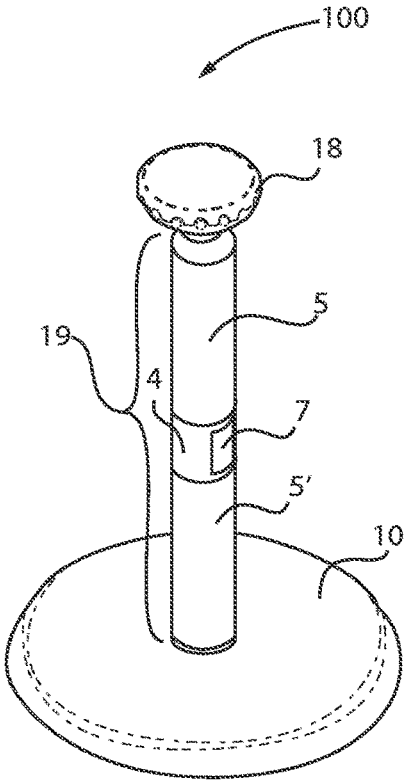
FIG. 6A illustrates a perspective view of the paper towel dispenser of FIGS. 1A-1B, in accordance with an embodiment of the present invention.

FIG. 6A illustrates a perspective view of the paper towel dispenser of FIG. 1A, in accordance with an embodiment of the present invention.

The perspective view of the paper towel dispenser 100 depicts an upper tube 5, a lower tube 5', and a central barrel 4. The central barrel 4 includes a pair of sliders 7 (or projections or extensions). A base 10 provides stability to the elongated portion or sleeve 19 (composed of the upper tube 5, the lower tube 5', and the central barrel 4). A finial 18 is axially disposed with respect to the upper tube 5, lower tube 5', and the central barrel 4.

Figure 6B:
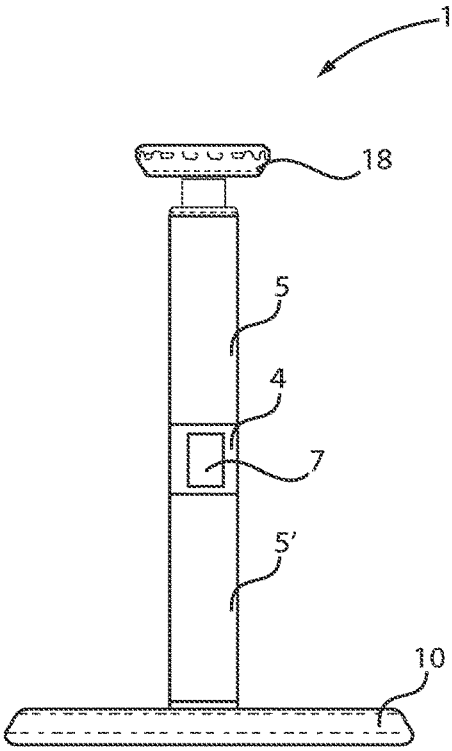
FIGS. 6B-6C illustrate side views of the paper towel dispenser depicting the sliders extending inwardly, in accordance with an embodiment of the present invention.
Figure 6C:
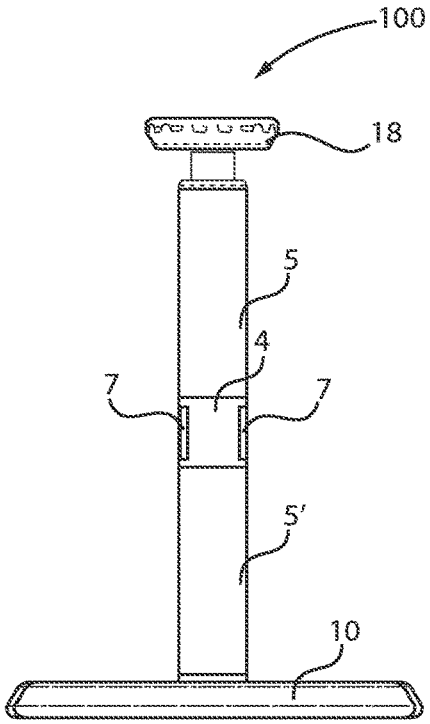

FIGS. 6B-6C illustrate side views of the paper towel dispenser depicting the sliders, in accordance with an embodiment of the present invention.

The side views clearly illustrate the sliders 7 attached to the central barrel 4.

FIG. 7A illustrates a perspective view of the paper towel dispenser of FIG. 4, in accordance with an embodiment of the present invention.

The perspective view of the paper towel dispenser 110 depicts an upper tube 5, a lower tube 5', and a central barrel 4. The central barrel 4 includes a pair of sliders 7 (or projections or extensions). A base 66 provides stability to the elongated portion or sleeve 19 (composed of the upper tube 5, the lower tube 5', and the central barrel 4). A finial 40 is axially disposed with respect to the upper tube 5, lower tube 5', and the central barrel 4.

FIG. 7B illustrates a side view of the paper towel dispenser of FIG. 4 depicting the sliders extending inwardly, in accordance with an embodiment of the present invention.

The side views clearly illustrate the sliders 7 attached to the central barrel 4.

Figure 8A:
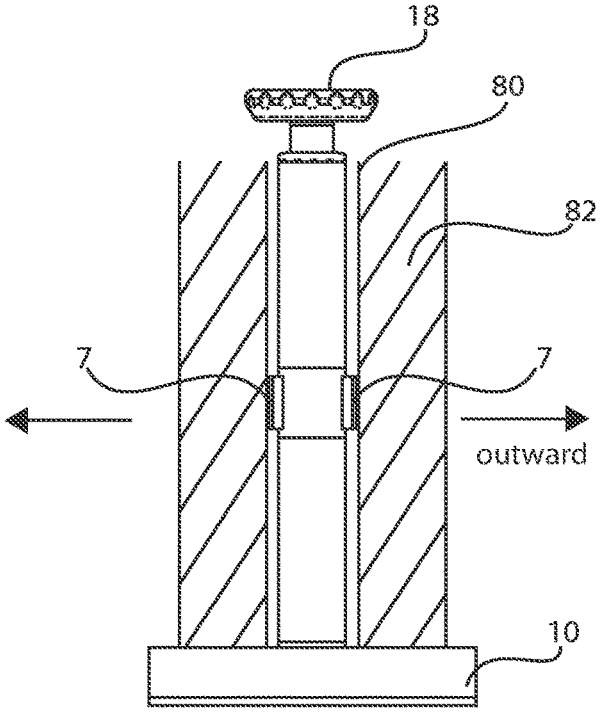
FIG. 8A illustrates the sliders extending outwardly to engage a paper towel tube of a paper towel when the finial is not depressed, in accordance with the first embodiment of the present invention.
Figure 8B:
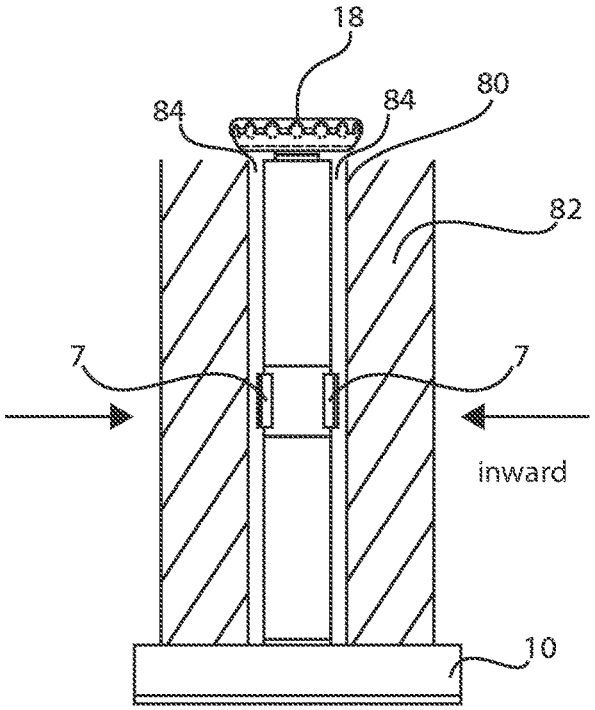
FIG. 8B illustrates the sliders shifting inwardly to disengage a paper towel tube of a paper towel when the finial is depressed, in accordance with the first embodiment of the present invention.

FIG. 8A illustrates the sliders extending outwardly to engage a paper towel tube of a paper towel when the finial is not depressed, in accordance with the first embodiment of the present invention, whereas FIG. 8B illustrates the sliders shifting inwardly to disengage a paper towel tube of a paper towel when the finial is depressed, in accordance with the first embodiment of the present invention.

In the first embodiment, including the actuator lock component 8 instead of the leaf springs 52, the up and down positions can be described as follows:

In FIG. 8A, in the "up" position, when no force is applied to the finial 18, the paper towel tube 80 of the paper towel 82 engages or directly contacts the sliders 7. When a user removes a paper towel sheet from the paper towel 82, due to friction between the sliders 7 and the paper towel tube 80, the entire assembly rotates (except for the base 10). As a result, the user can employ one hand to remove a paper towel sheet of the paper towel and this configuration prevents the material from unraveling from the roll when a desired quantity is torn from the roll.

In FIG. 8B, in the "down" position, when a force is applied to the finial 18, the paper towel tube 80 of the paper towel 82 disengages the sliders 7 such that a space or gap 84 is present between the sliders 7 and the paper towel tube 80. As a result, the user can remove the paper towel with tube and replace it with a new paper towel having a new paper towel tube.

Figure 9A:
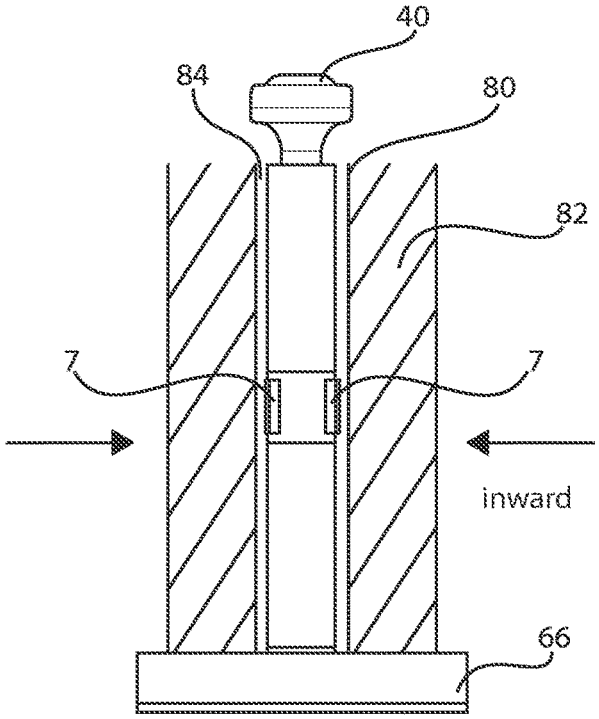
FIG. 9A illustrates the sliders extending inwardly to disengage a paper towel tube of a paper towel when the finial is not depressed, in accordance with the second embodiment of the present invention.
Figure 9B:
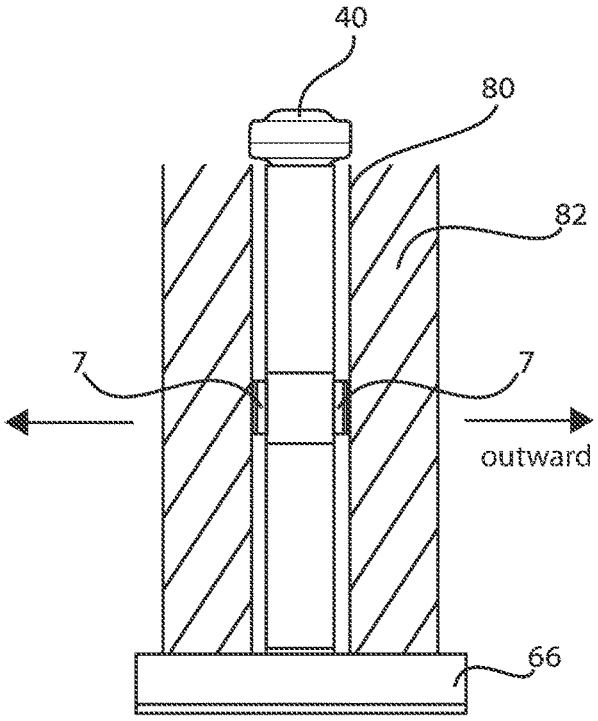
FIG. 9B illustrates the sliders shifting outwardly to engage a paper towel tube of a paper towel when the finial is depressed, in accordance with the second embodiment of the present invention.

FIG. 9A illustrates the sliders extending inwardly to disengage a paper towel tube of a paper towel when the finial is not depressed, in accordance with the second embodiment of the present invention, whereas FIG. 9B illustrates the sliders shifting outwardly to engage a paper towel tube of a paper towel when the finial is depressed, in accordance with the second embodiment of the present invention.

In the second embodiment, including the leaf springs 52 instead of the actuator lock component 8, the up and down positions can be described as follows:

In FIG. 9A, in the "up" position, when no force is applied to the finial 40, the paper towel tube 80 of the paper towel 82 is disengaged from and does not contact the sliders 7 such that a space or gap 84 is present between the sliders 7 and the paper towel tube 80. As a result, the user can remove the paper towel with tube and replace it with a new paper towel having a new paper towel tube. This is in contrast to the configuration of FIG. 8A.

In FIG. 9B, in the "down" position, when a force is applied to the finial 40, the paper towel tube 80 of the paper towel 82 engages or directly contacts the sliders 7. When a user removes a paper towel sheet from the paper towel 82, due to friction between the sliders 7 and the paper towel tube 82, the entire assembly rotates (except for the base 66). As a result, the user can employ one hand to remove a paper towel sheet of the paper towel and this configuration prevents the material from unraveling from the roll when a desired quantity is torn from the roll. This is in contrast to the configuration of FIG. 8B.

The second embodiment described in FIGS. 4-5B is different than the first embodiment described in FIGS. 1A-3B in that the second embodiment employs leaf springs 52 to displace the sliders 7, whereas the first embodiment employs the actuator lock component 8 to displace sliders 7. Additionally, in the first embodiment, in the "up" position, the sliders extend outwardly and in the "down" position, the sliders extend inwardly, whereas, in the second embodiment, in the "up" position, the sliders extend inwardly and in the "down" position, the sliders extend outwardly.

In summary, there are two separate and distinct embodiments. Each embodiment includes two static positions, that is, an "up" position and a "down" position. The first embodiment of the paper towel dispenser includes an actuator lock component 8 for engaging and displacing the sliders 7. An actuator unlock component 9 (or actuator) is positioned over the actuator lock component 8. The legs or extensions 9' of the actuator 9 extend in a downward direction. The body of the actuator 9 is thus positioned above the sliders 7. The second embodiment of the paper towel dispenser includes spring leafs 52 for engaging and displacing the sliders 7. The actuator 56 is positioned under the spring leafs 52. The legs or extensions or wedge members 58 of the actuator 56 extend in an upward direction. The body of the actuator 56 is thus positioned below the sliders 7. Additionally, in the first embodiment, in the "up" position, the sliders extend outwardly and in the "down" position, the sliders extend inwardly, whereas, in the second embodiment, in the "up" position, the sliders extend inwardly and in the "down" position, the sliders extend outwardly. Therefore, the same motions (upward or downward) in the first and second embodiments create different lateral displacement motions for the sliders 7.

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

It should also be understood that the example embodiments disclosed and taught herein are susceptible to numerous and various modifications and alternative forms. Thus, the use of a singular term, such as, but not limited to, "a" and the like, is not intended as limiting of the number of items. Furthermore, the naming conventions for the various components, functions, parameters, thresholds, and other elements used herein are provided as examples, and can be given a different name or label. The use of the term "or" is not limited to exclusive "or" but can also mean "and/or".

Having described preferred embodiments, which serve to illustrate various concepts, structures and techniques that are the subject of this patent, it will now become apparent to those of ordinary skill in the art that other embodiments incorporating these concepts, structures and techniques may be used. Additionally, elements of different embodiments described herein may be combined to form other embodiments not specifically set forth above.

Accordingly, it is submitted that that scope of the patent should not be limited to the described embodiments but rather should be limited only by the spirit and scope of the following claims.

The invention claimed is:

1. A paper towel dispenser comprising:
a sleeve attached to a base; and
a finial engaging interior components of the sleeve, the interior components including:
sliders disposed on opposed ends of a central barrel;
an actuator disposed over the central barrel, the actuator defining a pair of downward extensions; and
an actuator lock component disposed under the central barrel, the actuator lock component configured to laterally displace the sliders.

2. The paper towel dispenser of claim 1, wherein, when the finial is not depressed, the sliders extend outwardly to engage a paper towel tube of a paper towel.

3. The paper towel dispenser of claim 1, wherein, when the finial is depressed, the sliders extend inwardly to disengage a paper towel tube of a paper towel.

4. The paper towel dispenser of claim 1, wherein the actuator lock component is configured to engage an outer surface of angled portions of the sliders.

5. The paper towel dispenser of claim 4, wherein the pair of downward extensions is configured to engage an inner surface of the angled portions of the sliders.

6. The paper towel dispenser of claim 1, wherein a shaft accommodating a spring therearound extends centrally through the actuator, the central barrel, and the actuator lock component.

7. The paper towel dispenser of claim 1, wherein the downward extensions of the actuator engage the sliders from a top portion thereof.

8. A paper towel dispenser comprising:
a sleeve attached to a base; and
a finial engaging interior components of the sleeve, the interior components including:
sliders disposed on opposed ends of a central barrel;
an actuator disposed under the central barrel, the actuator defining a pair of upward extensions; and a pair of spring leafs disposed over the central barrel, the pair of spring leafs configured to laterally displace the sliders.

9. The paper towel dispenser of claim 8, wherein, when the finial is not depressed, the sliders extend inwardly to disengage a paper towel tube of a paper towel.

10. The paper towel dispenser of claim 8, wherein, when the finial is depressed, the sliders extend outwardly to engage a paper towel tube of a paper towel.

11. The paper towel dispenser of claim 8, wherein the spring leafs are configured to engage an outer surface of angled portions of the sliders.

12. The paper towel dispenser of claim 11, wherein the pair of upward extensions is configured to engage an inner surface of the angled portions of the sliders.

13. The paper towel dispenser of claim 8, wherein the upward extensions of the actuator engage the sliders from a bottom portion thereof.

* * * * *